US009814305B2

(12) United States Patent
Brus et al.

(10) Patent No.: US 9,814,305 B2
(45) Date of Patent: Nov. 14, 2017

(54) DETACHABLE TABLETOP SYSTEM AND BRACKET ASSEMBLY FOR ENGAGING A SUPPORTIVE RAILING

(71) Applicant: Terraza LLC, Grand Rapids, MI (US)

(72) Inventors: David Brus, Grand Rapids, MI (US); Scott Bird, Grand Rapids, MI (US)

(73) Assignee: Terraza LLC, Grand Rapids, MI (US)

( * ) Notice: Subject to any disclaimer, the term of this patent is extended or adjusted under 35 U.S.C. 154(b) by 0 days.

(21) Appl. No.: 15/173,014

(22) Filed: Jun. 3, 2016

(65) Prior Publication Data

US 2016/0353877 A1 Dec. 8, 2016

Related U.S. Application Data

(60) Provisional application No. 62/171,639, filed on Jun. 5, 2015.

(51) Int. Cl.

| | |
|---|---|
| ***A47B 23/00*** | (2006.01) |
| ***A47B 37/00*** | (2006.01) |
| ***A47B 5/02*** | (2006.01) |
| ***E04H 17/14*** | (2006.01) |
| ***A47G 7/04*** | (2006.01) |
| *E04H 15/62* | (2006.01) |

(52) U.S. Cl.

CPC ..... *A47B 5/02* (2013.01); *A47G 7/044* (2013.01); *E04H 17/14* (2013.01); *A47G 7/04* (2013.01); *A47G 7/045* (2013.01); *E04H 15/62* (2013.01)

(58) Field of Classification Search

CPC ..... A47B 5/02; A47B 37/04; A47G 7/045; A47G 7/044; A47H 27/00

USPC ..... 108/42, 157.1–158

See application file for complete search history.

(56) References Cited

U.S. PATENT DOCUMENTS

| | | | | | |
|---|---|---|---|---|---|
| 3,706,105 | A | * | 12/1972 | Nicholas | A47D 13/06 211/88.01 |
| 4,059,248 | A | * | 11/1977 | Kuntz | A47H 27/00 108/149 |
| 4,889,057 | A | * | 12/1989 | Chartrand | A47B 85/04 100/38 |
| 5,240,214 | A | * | 8/1993 | Birnbaum | A47B 88/044 248/214 |
| 5,472,164 | A | | 12/1995 | Contee, Jr. | |
| 5,653,178 | A | | 8/1997 | Huczka | |

(Continued)

FOREIGN PATENT DOCUMENTS

| | | |
|---|---|---|
| CA | 2132079 | 12/1999 |
| CN | 101176593 A | 5/2008 |

*Primary Examiner* — Daniel J Troy
*Assistant Examiner* — Timothy M Ayres
(74) *Attorney, Agent, or Firm* — Gardner, Linn, Burkhart & Flory, LLP

(57) ABSTRACT

A tabletop system for detachably engaging a railing provides a tabletop with a substantially planar upper surface and at least one bracket assembly. The bracket assembly includes an elongated member that is removably engaged with the tabletop and is configured to span over a handrail of the railing. The bracket assembly also includes a bracing member that is coupled with an end portion of the elongated member and extends downward proximate spindles of the railing. An engagement device is coupled with a lower portion of the bracing member and is configured to detachably engage an adjacent pair of the spindles for rigidly securing the bracket assembly to support the tabletop.

20 Claims, 17 Drawing Sheets

(56) References Cited

U.S. PATENT DOCUMENTS

| | | | | |
|---|---|---|---|---|
| 6,474,244 | B1 | 11/2002 | Karpinski | |
| 6,931,998 | B1 * | 8/2005 | Leese | A47B 5/02 108/152 |
| 7,121,213 | B2 * | 10/2006 | Viazanko | A47B 13/08 108/42 |
| 8,336,837 | B2 | 12/2012 | Gephart et al. | |
| 8,915,197 | B2 * | 12/2014 | Raml | A47B 5/00 108/152 |
| 8,979,045 | B2 | 3/2015 | Petrakis | |
| 2007/0034758 | A1 * | 2/2007 | Bates | E04H 12/2276 248/218.4 |
| 2007/0101908 | A1 | 5/2007 | Makita | |
| 2009/0000523 | A1 | 1/2009 | Ciardelli | |
| 2009/0020047 | A1 | 1/2009 | Noble et al. | |

* cited by examiner

DETACHABLE TABLETOP SYSTEM AND BRACKET ASSEMBLY FOR ENGAGING A SUPPORTIVE RAILING

CROSS-REFERENCE TO RELATED APPLICATIONS

The present application claims benefit under 35 U.S.C. §119(e) of U.S. Provisional Application Ser. No. 62/171,639, entitled DETACHABLE TABLETOP SYSTEM AND BRACKET ASSEMBLY FOR ENGAGING A SUPPORTIVE RAILING, filed Jun. 5, 2015, which is hereby incorporated herein by reference in its entirety.

FIELD OF THE INVENTION

The present invention generally relates to tables and outdoor furniture, and more particularly to tabletops, such as countertops and bar tops, that may be temporarily supported on a deck or patio, such as with support from a railing or with portions thereof.

BACKGROUND OF THE INVENTION

It is common for outdoor areas and other gathering areas to have a railing constructed around or adjacent to decks, patios, and other platforms to prevent people and objects from falling or otherwise moving outside of the areas enclosed by the railing. These areas, however, can be limited in the amount of space available for individuals and furniture to occupy the enclosed area and can be restricted or otherwise limited in the types of modifications that can be done to the deck or railing structure, such as in rented or condo properties.

It is generally known, as disclosed in U.S. Pat. No. 5,653,178 and U.S. patent application Ser. No. 12/137,052 (U.S. Publication No. 2009/0020047), Ser. No. 12/163,595 (U.S. Publication No. 2009/0000523), and Ser. No. 11/593,425 (U.S. Publication No. 2007/0101908), to affix a tabletop to a railing for providing a table-like surface. However, these known tabletops and countertop systems can be difficult to temporarily mount to a railing and provide a well-supported surface, while also being adaptable to a wide variety of railing structures, which frequently use different materials, have different shaped handrails, and use inconsistent spindle types and spacing.

SUMMARY OF THE PRESENT INVENTION

The present invention provides a detachable tabletop system with a bracket assembly that is configured to detachably engage with a railing for supporting a tabletop, such as a bar top or a counter top. The bracket assembly provides an upper portion that rests on a handrail of the railing and a lower portion that attaches to at least one spindle of the railing, thereby supporting the upper portion of the bracket assembly for attaching the tabletop in a substantially horizontal orientation. The lower portion of the bracket assembly is adapted to temporarily secure to various types of spindles and different spindle spacing. Depending on the tabletop size, configuration, and desired support, multiple bracket assemblies may be attached along the railing. Accordingly, the bracket assembly may also be configured to attach to the tabletop at multiple locations, such that if more than one bracket assembly is used, the tabletop may be secured to each desired bracket assembly. The detachable tabletop system thereby provides the ability to customize and interchange the tabletop, as well as the ability to easily detach and store the tabletop system when not in use.

According to one aspect of the present invention, a tabletop system configured to detachably engaging a railing provides a bracket assembly and a tabletop configured to removably engage the upper portion of the bracket assembly and span over the handrail of the railing. An upper portion of the bracket assembly is configured to rest on the handrail and a lower portion of the bracket assembly extends downward from the upper portion to an area below the handrail and attaches to at least one spindle of the railing. The lower portion of the bracket assembly is configured to secure to the at least one spindle for supporting a substantially planar upper surface of the tabletop in a generally horizontal orientation.

According to another aspect of the present invention, a bracket assembly of a tabletop system includes an upper portion configured to rest on a handrail of a railing and support a tabletop that spans over the handrail. A lower portion of the bracket assembly extends downward from the upper portion of the bracket assembly for being positioned at an area below the handrail of the railing. An engagement device is disposed at the lower portion of the bracket assembly and is configured to attach to at least one spindle of the railing. The engagement device is configured to engage opposing sides of the at least one spindle for rigidly securing the bracket assembly to the railing.

According to yet another aspect of the present invention, a tabletop system configured to detachably engage a railing includes a support bracket having an upper bracket member that is configured to rest on a handrail of a railing. A lower bracket member of the support bracket extends downward from the upper bracket member for extending toward spindles of the railing. An engagement device is disposed at the lower bracket member and is configured to engage opposing sides of a spindle of the railing for securing the bracket assembly to the railing. A tabletop is configured to span over the handrail of the railing and engage the upper bracket member of the support bracket. An attachment feature is disposed on the upper bracket member and/or the tabletop for releasably engaging the tabletop with the upper bracket member.

These and other objects, advantages, purposes, and features of the present invention will become apparent upon review of the following specification in conjunction with the drawings.

DETAILED DESCRIPTION OF EMBODIMENTS

Figure 1:
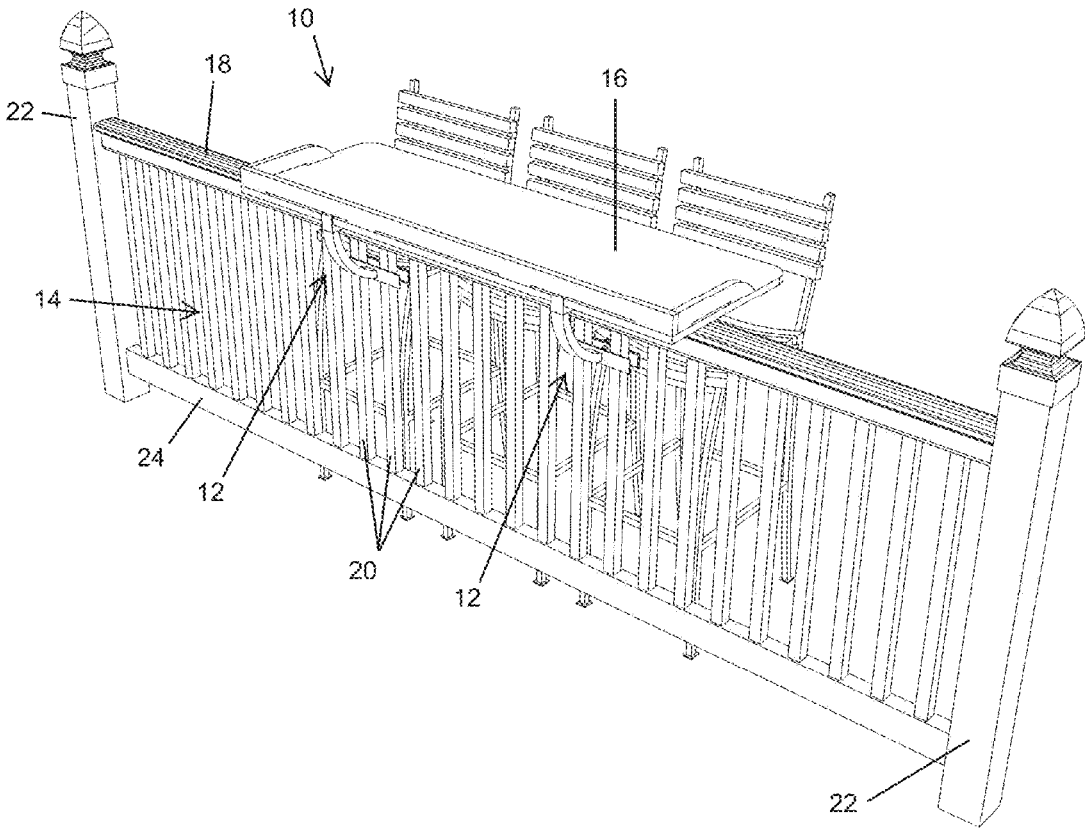
FIG. 1 is an upper perspective view of a detachable tabletop system shown with bracket assemblies secured to a railing and supporting a tabletop.
Figure 2:
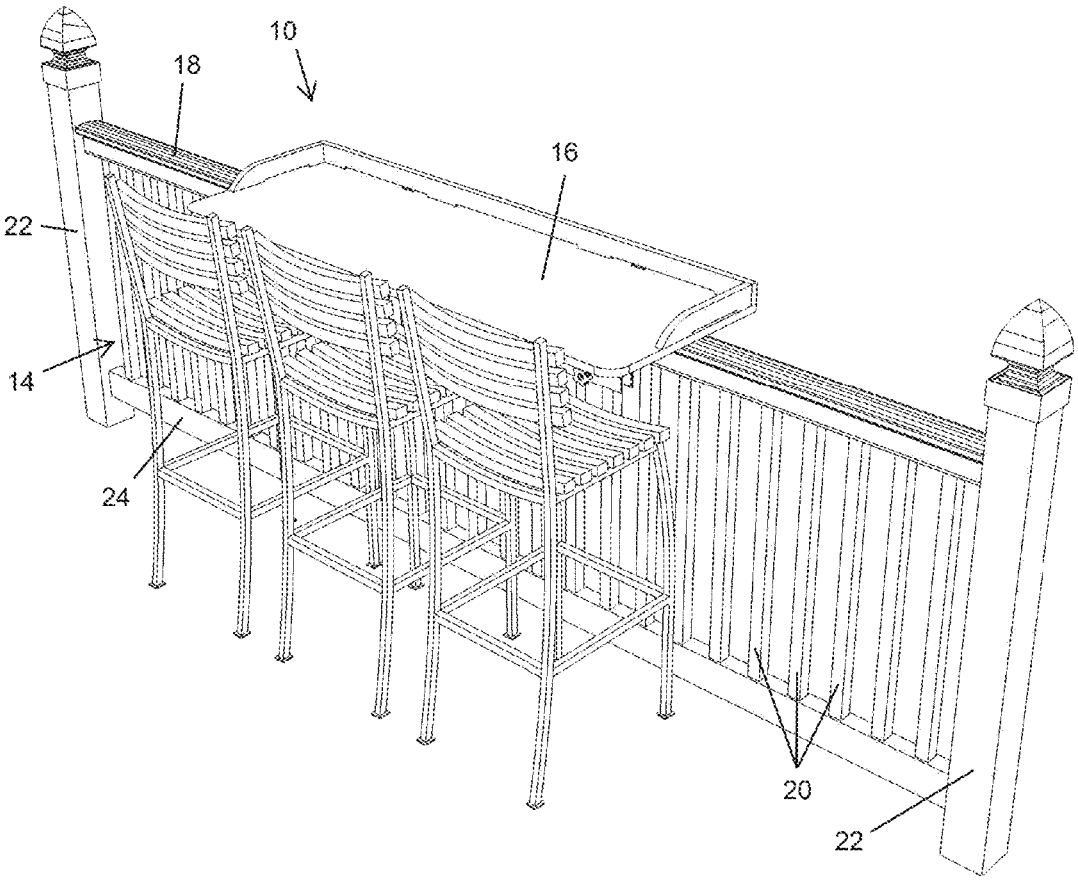
FIG. 2 is an upper perspective view of the detachable tabletop system shown in FIG. 1, taken from an opposing side of the railing from FIG. 1.
Figure 3:
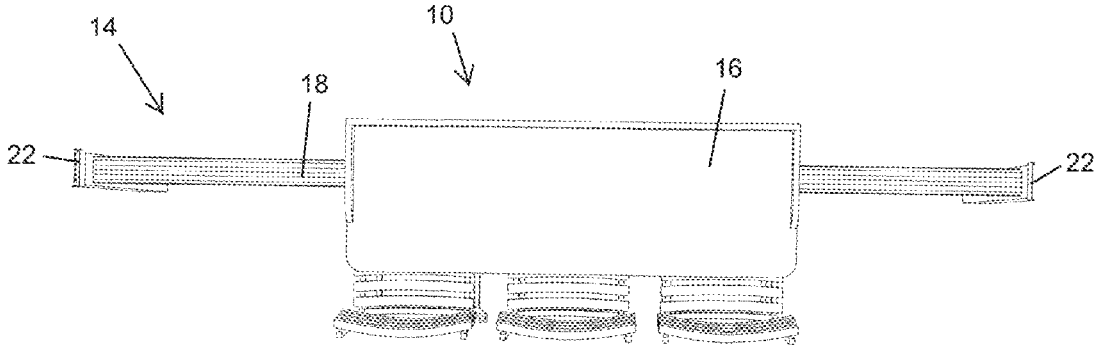
FIG. 3 is a top plan view of the detachable tabletop system shown in FIG. 1.
Figure 4:
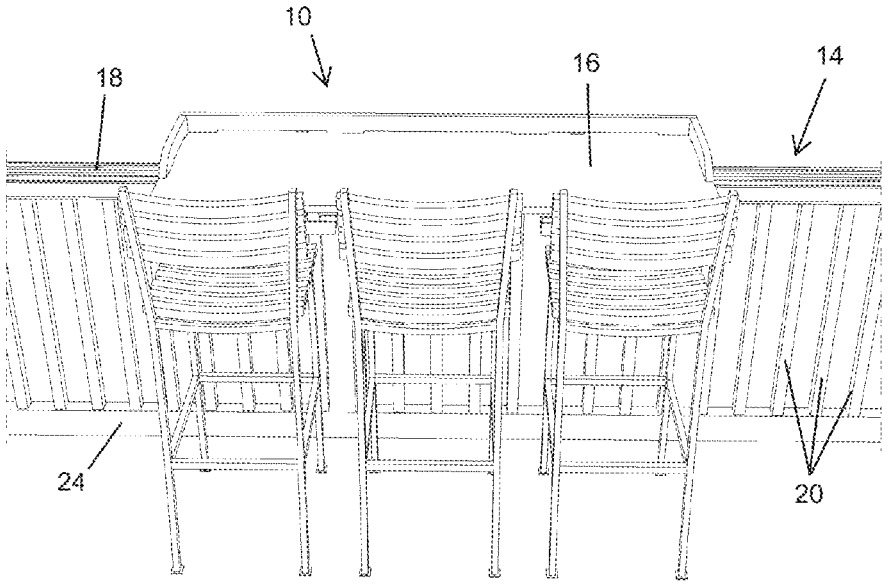
FIG. 4 is an upper perspective view of the detachable tabletop system shown in FIG. 1, taken from an opposing side of the railing from FIG. 1.
Figure 5:
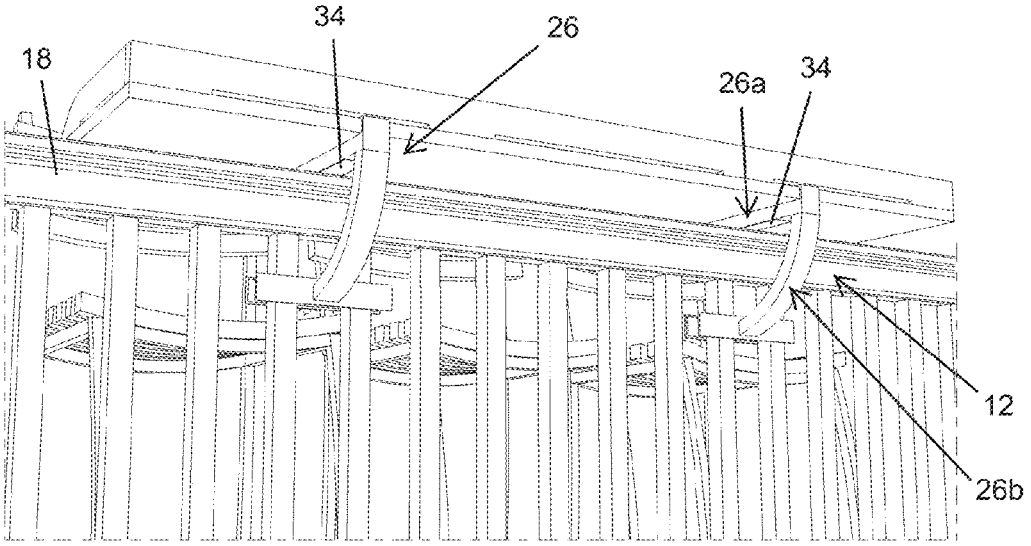
FIG. 5 is a lower perspective view of the detachable tabletop system shown in FIG. 1.
Figure 6:
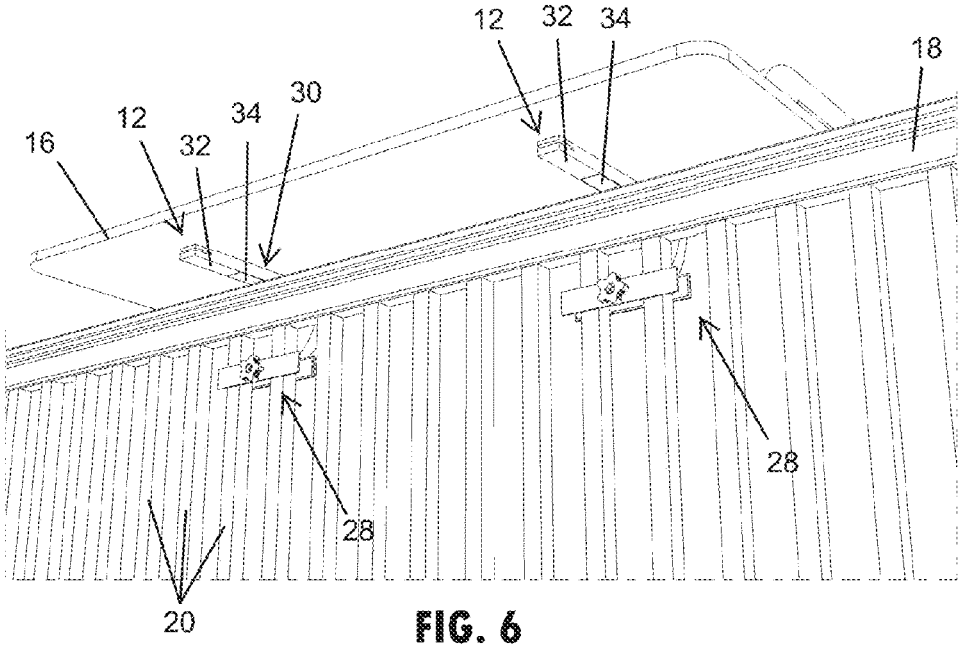
FIG. 6 is a lower perspective view of the detachable tabletop system shown in FIG. 1, taken from an opposing side of the railing from FIG. 1.

Referring now to the drawings and the illustrative embodiments depicted therein, a detachable tabletop system 10 is provided with a bracket assembly 12 that is configured to detachably engage a railing 14 for supporting a tabletop 16, such as a bar top, a counter top, or other table-like structure. The bracket assembly 12 is secured to the railing 14 by both resting on and/or engaging a handrail 18 of the railing 14 for providing generally vertical support and by attaching to at least one spindle 20 of the railing 14 for providing additional support to prevent the bracket assembly and supported tabletop from tipping or tilting on either side of the handrail, thereby generally maintaining the tabletop in a substantially horizontal orientation. The bracket assembly attaches to the spindle or spindles in a manner that allows the bracket assembly to be temporarily secured to various types of spindles and accommodate spindles that are separated with different or inconsistent spacing. Also, depending on the size and configuration of the desired tabletop, one or more bracket assemblies 12 may be attached along the railing 14 to support the tabletop 16, such as shown in FIGS. 1-8. Accordingly, to accommodate different placements or attachment locations of the bracket assemblies 12 along the railing 14, the bracket assembly may also be configured to selectively attach to the tabletop 16 at multiple locations along the length of the table. The detachable tabletop system 10 thereby provides the ability to customize and interchange the tabletop 16 as desired, as well as the ability to easily detach and store the tabletop system 10 when not in use.

The detachable tabletop system 10 may be attached to one or more sections of railing, although the detachable tabletop system illustrated in FIGS. 1-8 is secured to a single section of railing 14 that has the handrail 18 spanning generally horizontally between two upright support posts 22. As shown in FIGS. 1-8, the bracket assemblies 12 are mounted on and vertically supported by the handrail 18, which provides a generally curved or rounded top surface for supporting the bracket assemblies 12. However, other handrail designs, such as a peaked or flat top surfaces, thin metal handrails, and uneven natural log handrails among others, can be securely mounted by the bracket assemblies of the detachable tabletop system.

The spindles 20 of the railing 14, such as illustrated in FIGS. 1-4, extend down from the handrail 18 and secure to a lower rail 24 that extends between the support posts 22 in generally parallel alignment with the handrail 18. The illustrated spindles 20 also extend substantially linearly in a generally vertical orientation and have a substantially square cross-sectional shape. However, it also is contemplated that the detachable tabletop system 10 may optionally attach to other railings and spindle arrangements. For instance, the railing may have one or more different spindles; the uppermost handrail may be vertically spaced from the spindles; the spindles may curve inward or outward; the spindles may extend downward diagonally, interconnect, and form various designs in the area below the handrail; and the spindles may have different and multiple cross-sectional shapes, such as a metal tube spindle, an arched or baroque-style metal slat spindle, a turned wood spindle, and other conceivable spindle shapes and designs.

The bracket assembly 12 includes a support bracket 26, such as illustrated in FIGS. 5-8, that has an upper portion 26*a* that rests on the handrail 18 of the railing 14 and a lower portion 26*b* that extends downward from the upper portion to an area below the handrail 18 for allowing the bracket assembly 12 to engage or attach to at least one spindle 20 of the railing, such as with an engagement device 28 or clamp or the like. Accordingly, the support bracket 26 is configured to firmly and rigidly support the bracket assembly 12 on the railing 14 for attaching the tabletop 16 in a substantially horizontal orientation. The engagement device 28 at the lower portion 26*b* of the bracket assembly 12 is adapted to temporarily secure to various types of spindles and accommodate spindles that are separated with different or inconsistent spacing. The engagement device 28 attaches to at least one spindle of the railing engaging opposing sides of the spindle, such as by securing a clamping device to the opposing sides of the spindle. Optionally, the engagement device may alternatively be configured to snap-fit around or between spindles, tie to the spindles, or otherwise temporarily engage or attach to at least one of the spindles to support the bracket assembly.

The upper portion 26*a* of the bracket assembly 12 supports the detachable tabletop 16 and rests on a top surface of the handrail 18. As shown in FIGS. 5-8, the upper portion 26*a* of the bracket assembly 12 includes an elongated bracket member 30 that is configured to span over the handrail 18 of the railing 14. The elongated bracket member 30 may include a lower support surface 32 that is configured to directly contact the top surface of the handrail 18. The lower support surface 32 of the elongated bracket member 30 may include a padded section 34, such as illustrated in FIGS. 5-8, which may be disposed at an intermediate portion of the elongated bracket member 30, generally disposed between the opposing end sections of the elongated bracket member 30. The padded section 34 is configured to directly contact the top surface of the handrail 18 and may function to protect the upper surface of the handrail 18 from indentations, scratching, or other wear. Also, the padded section 34 may function to increase frictional resistance and prevent lateral movement between the elongated bracket member 30 of the bracket assembly 12 and the handrail 18, such as upon weighted compression of the padded section 34 over the rounded top surface of the handrail. The padded section 34 may comprise one or a combination of materials, including a rubber material, an elastomeric material, a cork material, a sponge material, a polystyrene material, and other conceivable materials that may provide such functional characteristics.

Figure 11:
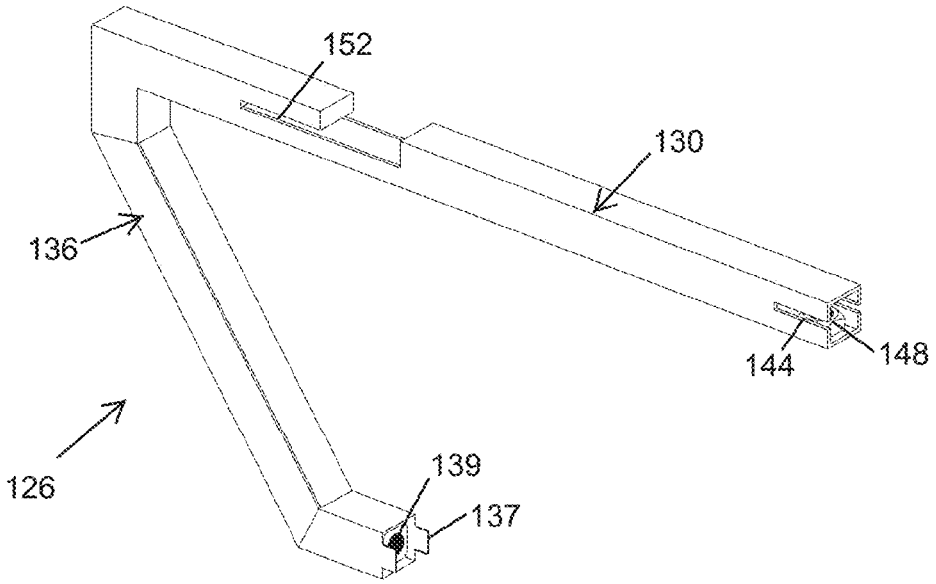
FIG. 11 is an upper perspective view of a support bracket of the bracket assembly shown in FIG. 9.
Figure 11A:
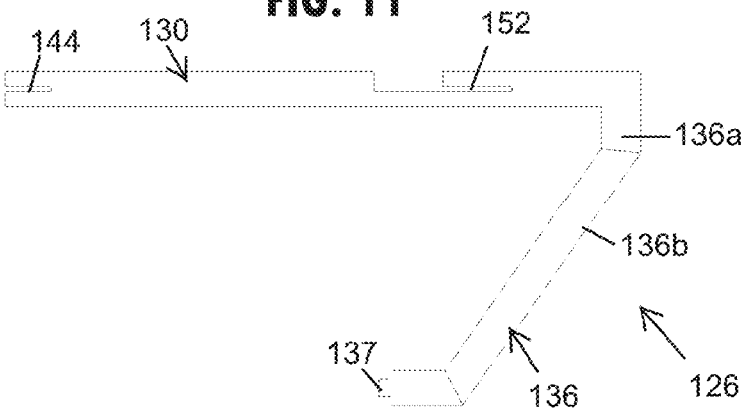
FIG. 11A is an elevational view of the support bracket shown in FIG. 11.
Figure 11B:
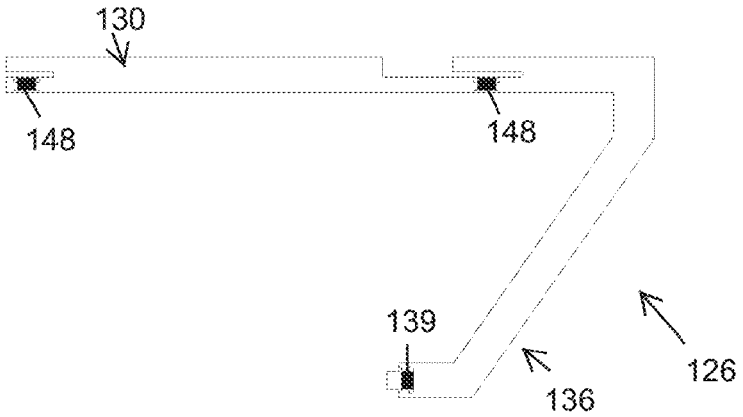
FIG. 11B is a cross-sectional view of the support bracket shown in FIG. 11.
Figure 12:
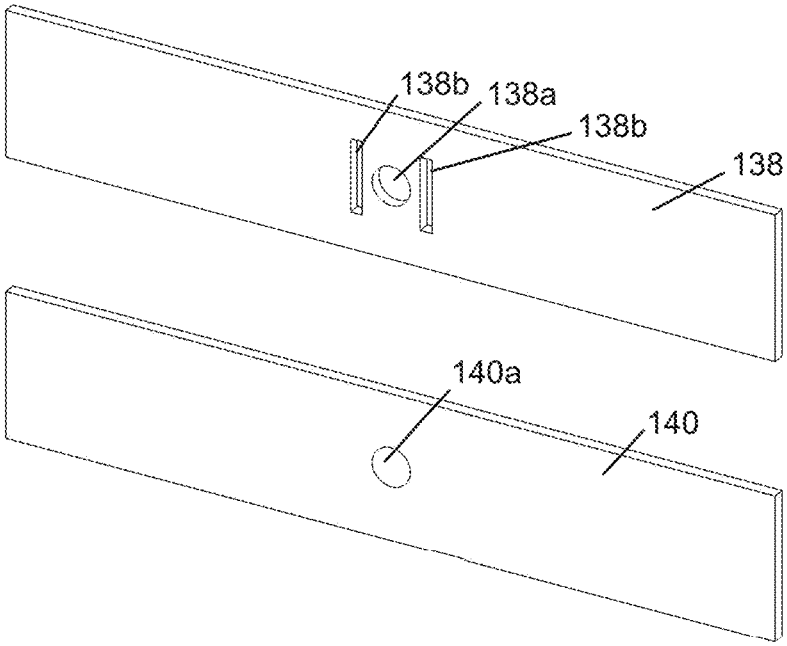
FIG. 12 is a perspective view of clamp plates of the bracket assembly shown in FIG. 9.
Figure 12A:
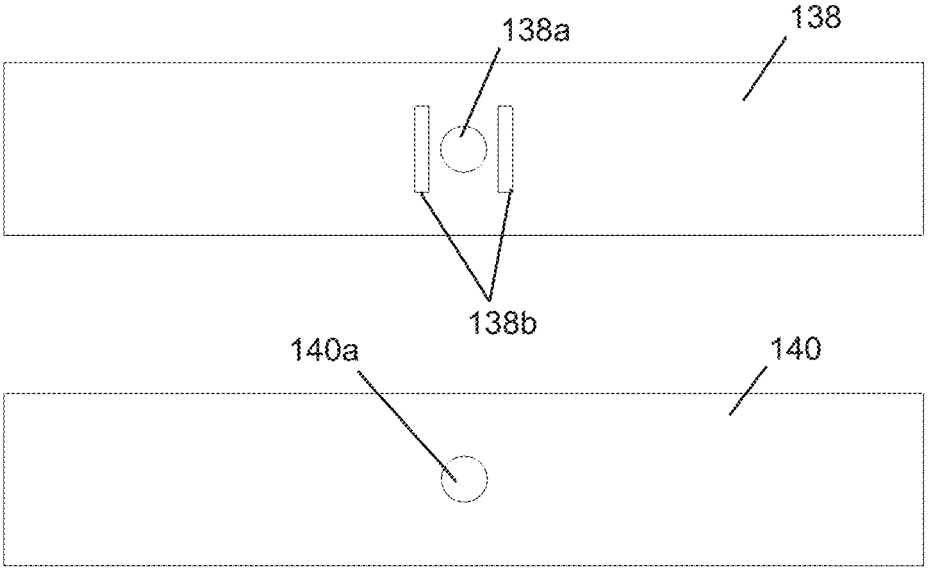
FIG. 12A is an elevational view of the clamp plates shown in FIG. 12.
Figure 13:
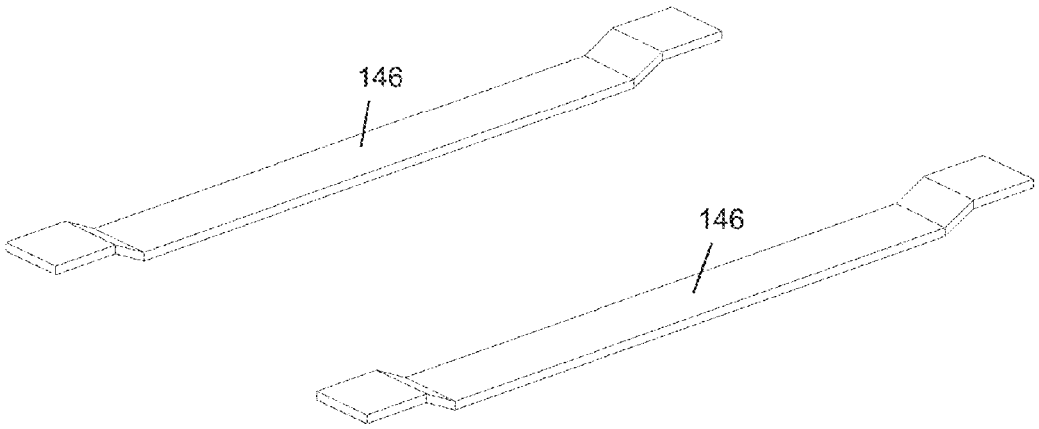
FIG. 13 is a perspective view of base brackets of the bracket assembly shown in FIG. 9.
Figure 13A:
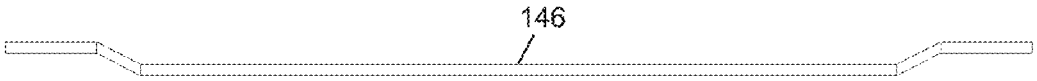
FIG. 13A is an elevational view of the base bracket shown in FIG. 13.
Figure 14:
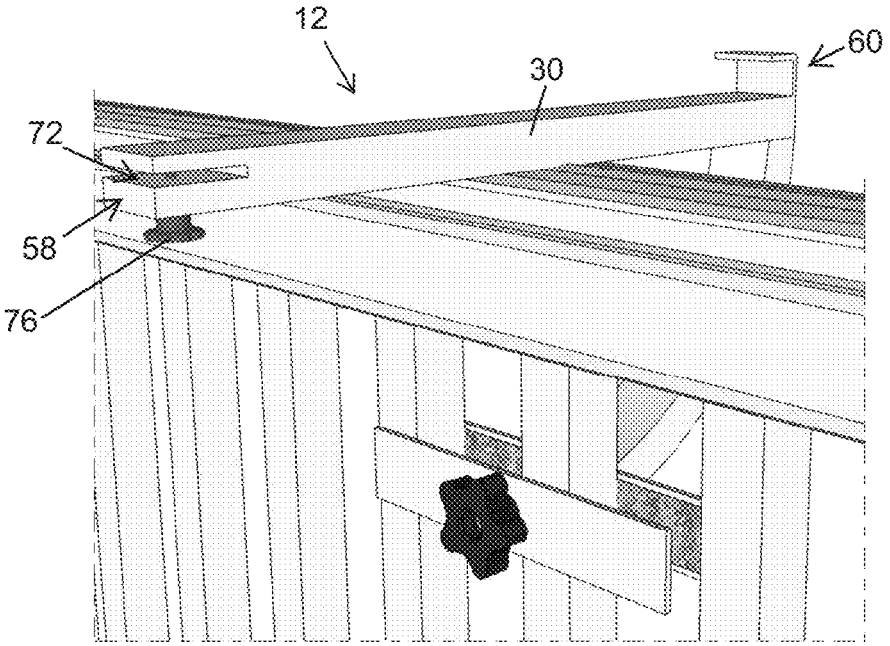
FIG. 14 is an upper perspective view of a bracket assembly of the detachable tabletop system shown secured to a railing.
Figure 15:
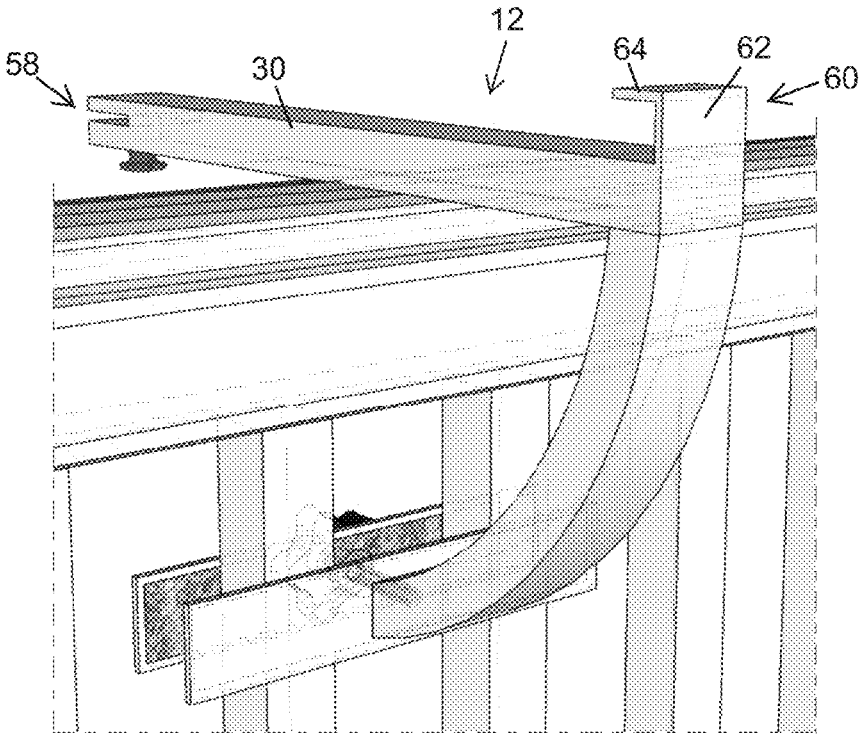
FIG. 15 is an upper perspective view of the bracket assembly shown in FIG. 14, taken from an opposing side of the railing and illustrating concealed portions of the bracket assembly and railing with phantom lines.
Figure 16:
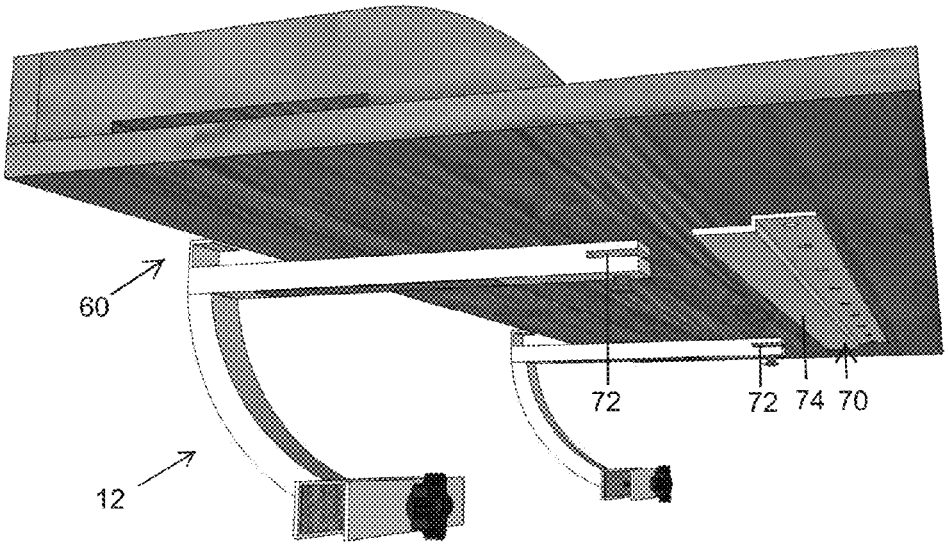
FIG. 16 is a lower perspective view of a tabletop disengaged from the bracket assemblies shown in FIG. 14.
Figure 17:
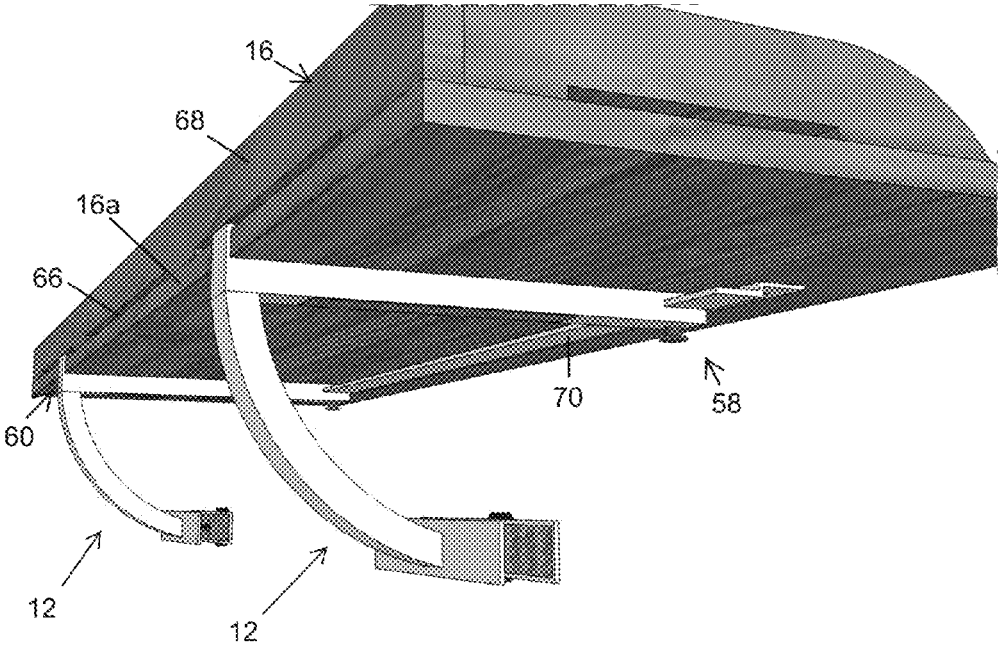
FIG. 17 is a lower perspective view of the tabletop engaged with the bracket assemblies shown in FIG. 16.
Figure 18:
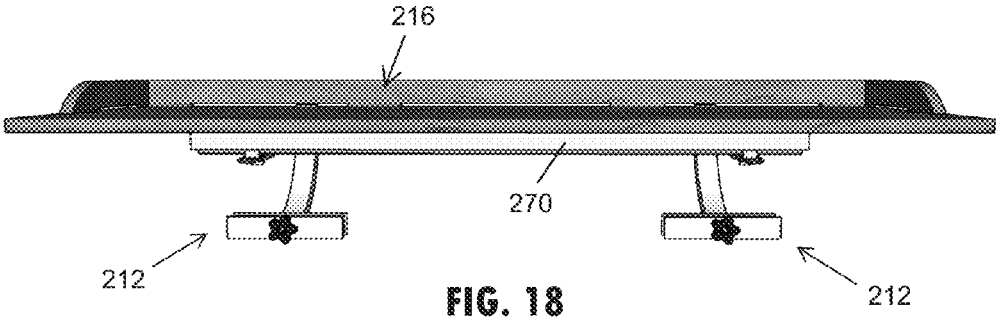
FIG. 18 is an elevational view of a detachable tabletop system, showing a tabletop engaged with bracket assemblies having a spring-biased clasp engaging a base bracket on a lower side of a tabletop.
Figure 19:
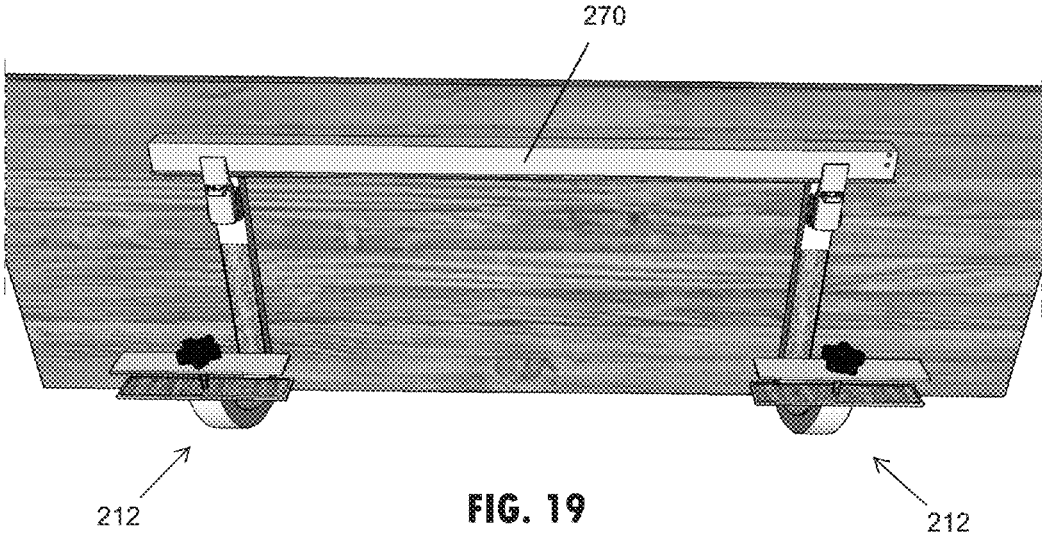
FIG. 19 is a lower perspective view of the tabletop engaged with the bracket assemblies shown in FIG. 18.
Figure 20:
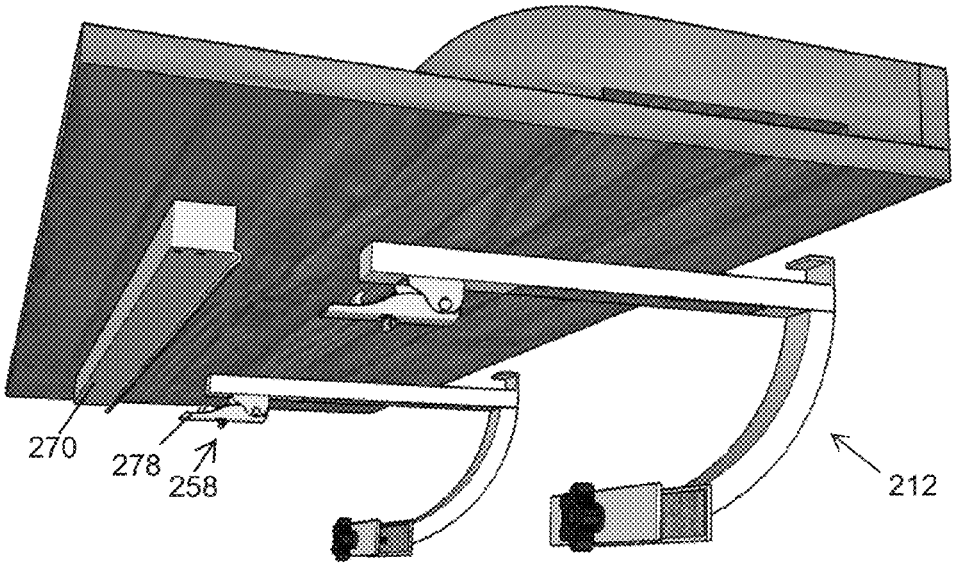
FIG. 20 is a lower perspective view of the tabletop disengaged from the bracket assemblies shown in FIG. 18.
Figure 21:
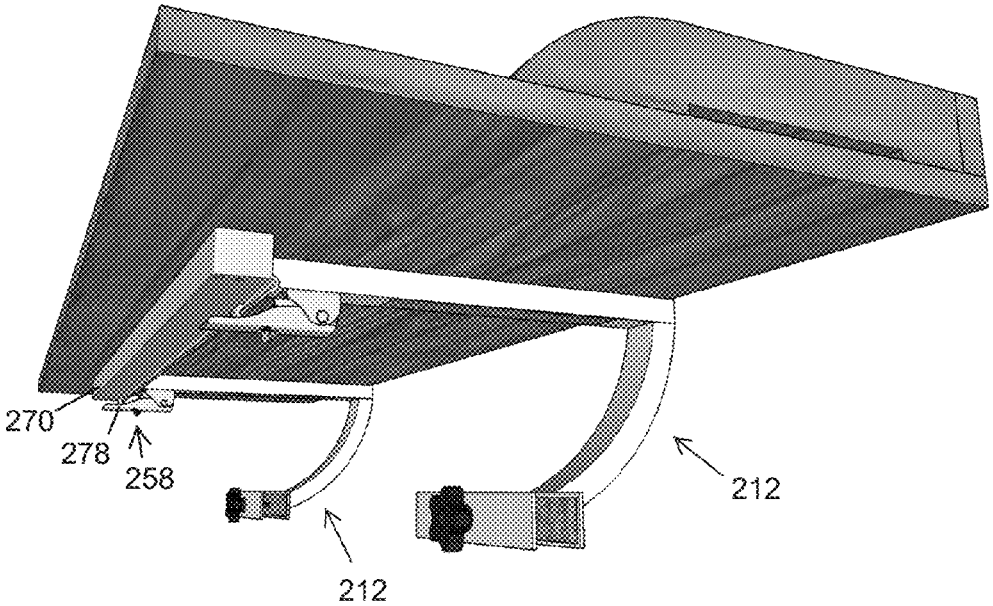
FIG. 21 is a lower perspective view of the tabletop engaged with the bracket assemblies shown in FIG. 18.
Figure 22:
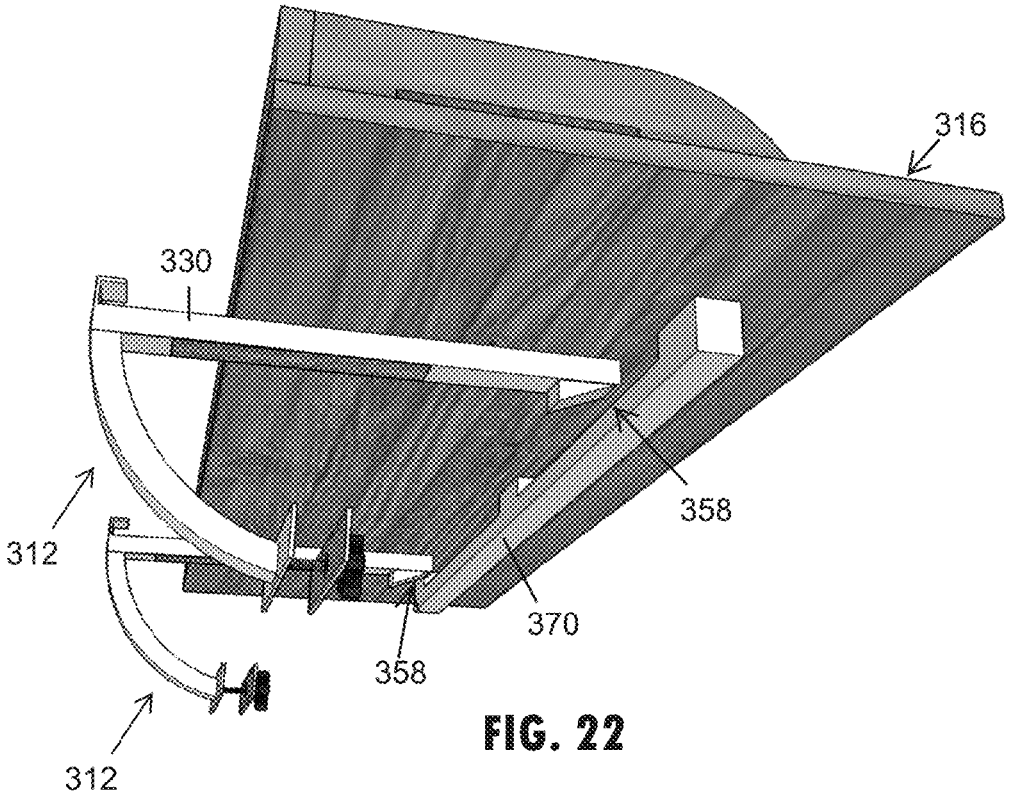
FIG. 22 is a lower perspective view of a tabletop disengaged from bracket assemblies having wedge-shaped attachment features.
Figure 23:
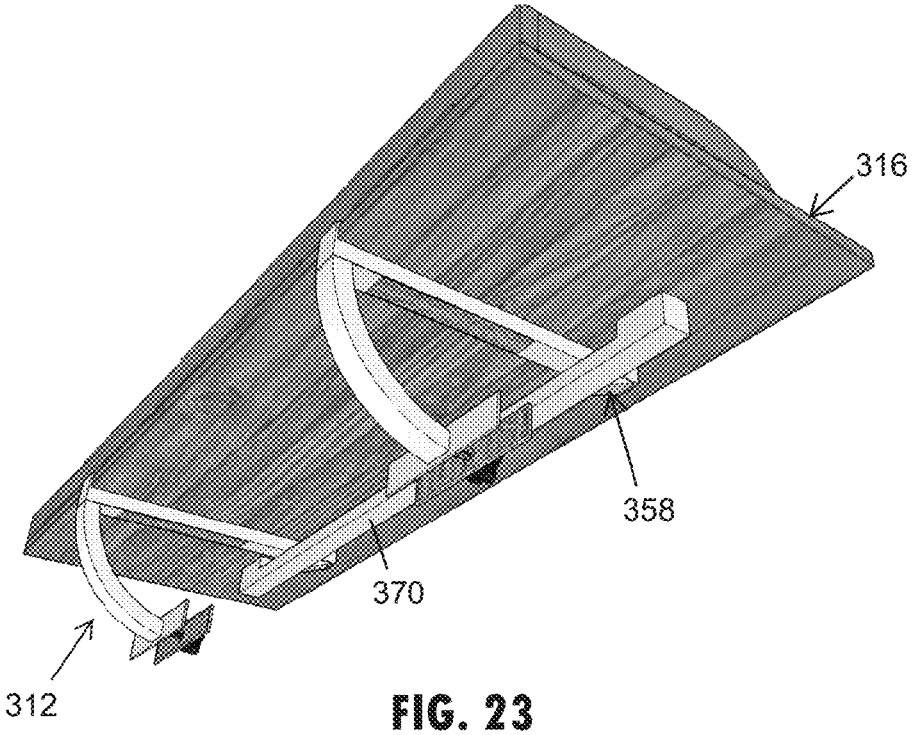
FIG. 23 is a lower perspective view of the tabletop engaged with the bracket assemblies shown in FIG. 22.
Figure 24:
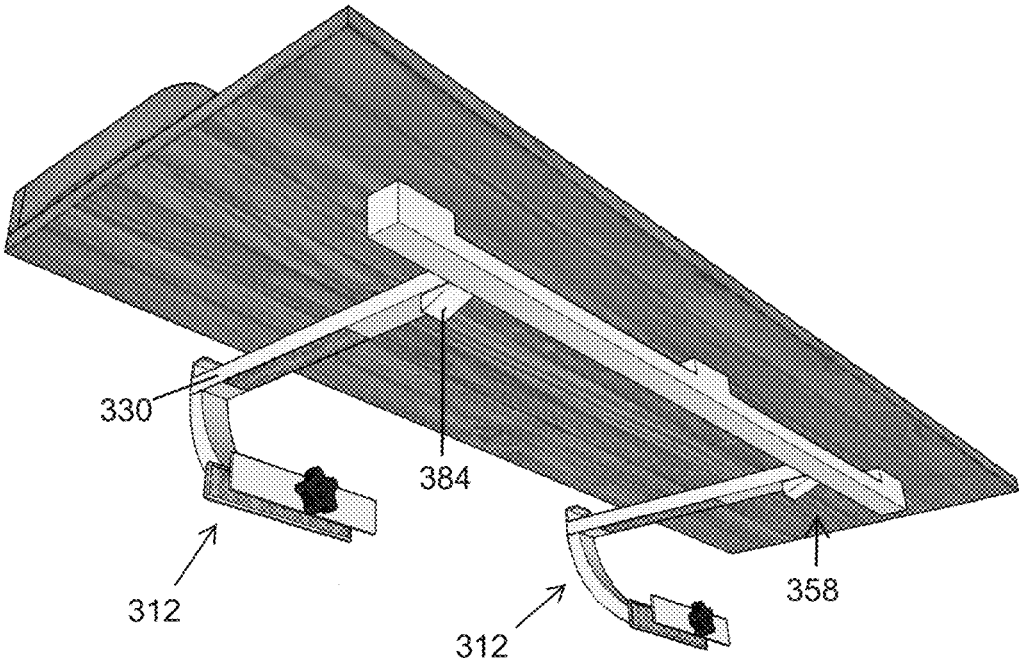
FIG. 24 is a lower perspective view of the tabletop disengaged from the bracket assemblies as shown in FIG. 22, taken from an opposing side of the tabletop.
Figure 25:
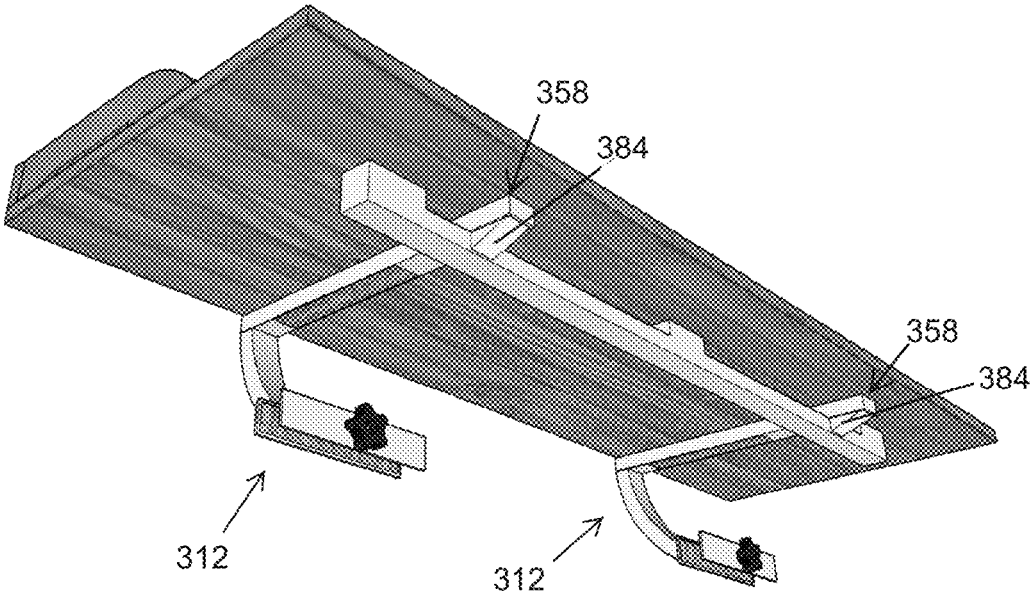
FIG. 25 is a lower perspective view of the tabletop engaged with the bracket assemblies shown in FIG. 23, taken from an opposing side of the tabletop.

The bracket assembly 12 also includes an angled bracket member or bracing member 36 that extends downward from an end section of the elongated bracket member 30, extending at an angle toward the spindles 20 of the railing, such as at a curvature (FIGS. 5-8) or generally linearly (FIGS. 11-11B). The bracing member 36 functions to provide support to an overhanging portion of the elongated bracket member 30, away from the handrail 18, by extending down below the handrail 18 to brace against a mid-height section of the railing 14 and engage at least one spindle 20 of the railing. As shown in FIGS. 5-8, the bracing member 36 integrally extends downward from a distal end of the elongated member and angles toward the spindles of the railing in an arcuate shape that curves around the handrail 18. This angled and arcuate shape provides space available between the handrail and the bracing member 36, which allows for various in handrail designs to be mounted by the bracket assembly 12. It is also contemplated that the bracing member may optionally extend down from the end section of the elongated bracket member away from the distal end, closer to the handrail and/or may include different shapes and designs, such as multiple members extending down from the upper portion of the bracket assembly to brace against the mid-vertical section of the railing.

The lower portion 26*b* of the bracket assembly 26 may be provided with an engagement device 26, such as disposed at a lower end of the a bracing member 36, for use in detachably engaging at least one of the spindles 20 of the railing 14. Referring again to the tabletop system shown in FIGS. 5-8, the engagement device 28 disposed at the lower portion of the bracing member 36 engages an adjacent pair of the spindles 20 for rigidly securing the bracket assembly 12 to the railing 14, thereby securely supporting the upper portion 26*a* of the support bracket 26 for horizontally supporting a tabletop 16. The engagement device 28 may be provided with a clamping device that is disposed at the lower end of the bracing member 36 and is configured to clamp opposing interior and exterior sides of the adjacent spindles 20. It is also conceivable that the engagement device 28 may optionally include various fastening or clamping mechanisms or the like that functions to temporarily provide a secure connection of the bracing member to the mid-height section of the railing, thereby securing the bracket assembly with the railing in a manner sufficient to support a tabletop over the handrail.

Figure 7:
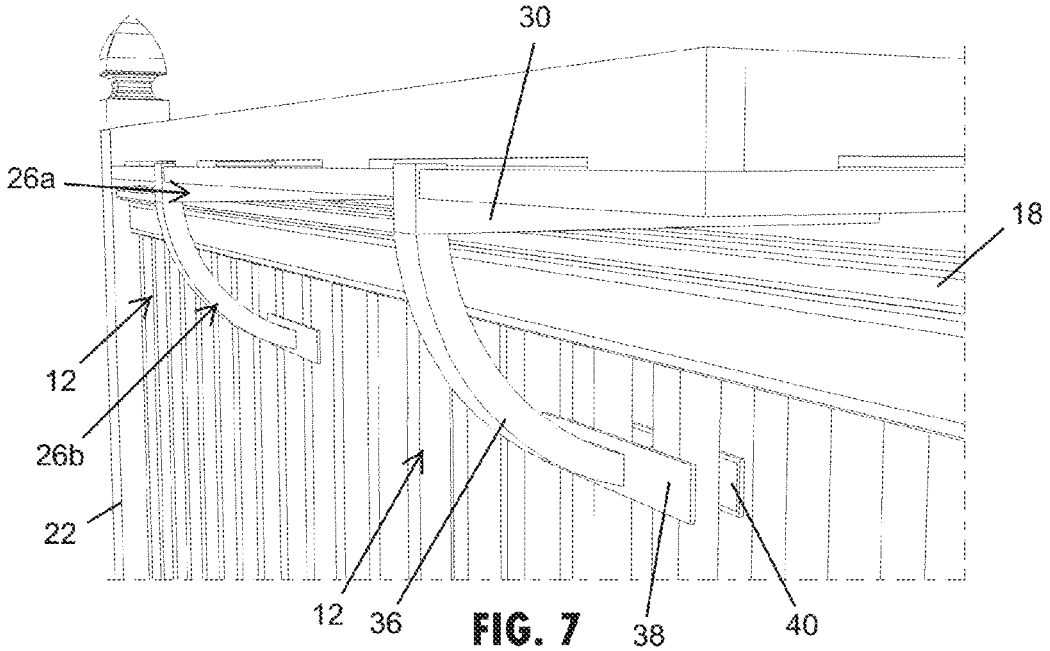
FIG. 7 is an enlarged side perspective view of the detachable tabletop system shown in FIG. 1.
Figure 8:
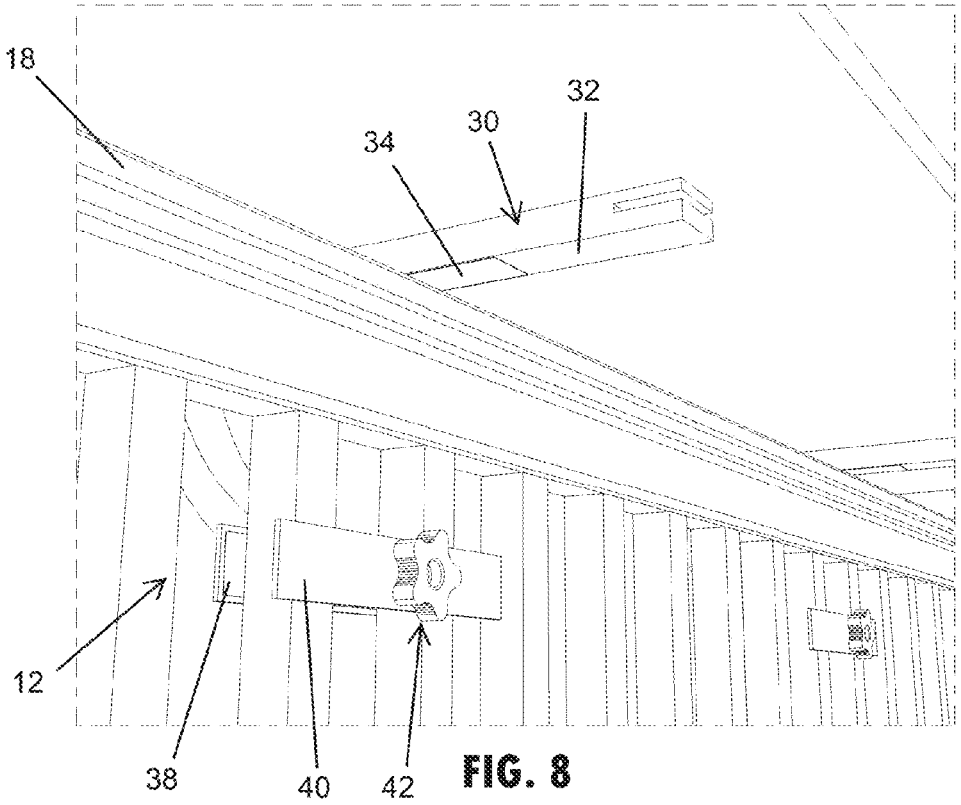
FIG. 8 is an enlarged lower perspective view of the detachable tabletop system, taken from an opposing side of the railing from FIG. 1.
Figure 9:
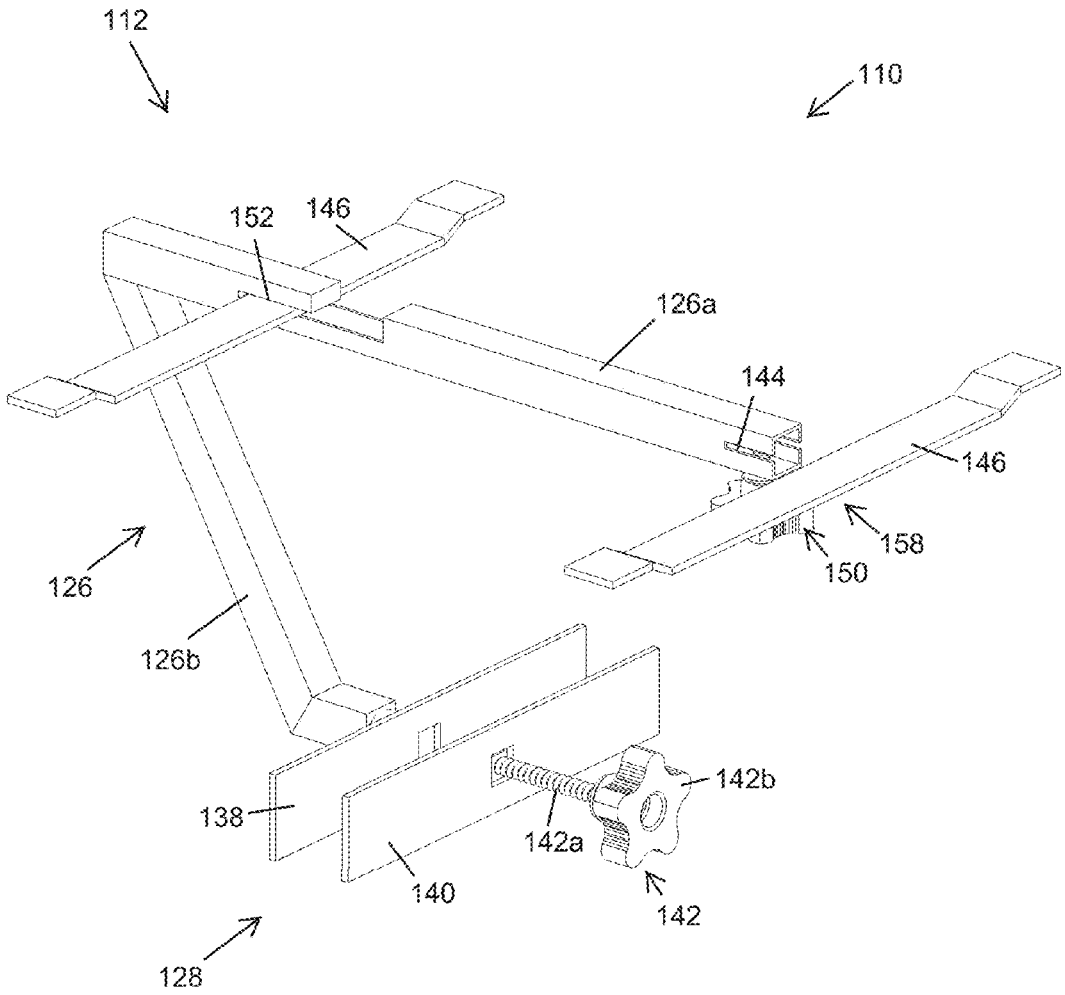
FIG. 9 is an upper perspective view of a bracket assembly and tabletop base brackets of a detachable tabletop system.

As shown in FIGS. 5-8, the engagement device 28 includes a first plate 38 that is coupled with the bracing member 36 and may be integrally formed therewith. The first plate 38 of the clamping device is configured to span laterally between outside surfaces of the adjacent pair of spindles 20. Similarly, the engagement device 28 includes a corresponding second plate 40 that is configured to similarly span between inside surfaces of the adjacent pair of spindles 20 and over the void between the spindles. The second plate 40 may be secured to the first plate 38, such as with a rotatable fastener 42 that is configured to extend through the spindles 20 and clamp the spindles between the first and second plates 38, 40. However, in additional embodiments, such as with horizontally or diagonally spanning spindles, the plates may be oriented or capable of being adjusted to span vertically or otherwise to interface with the spindles on opposing sides of a void through the railing. As also shown in FIGS. 7-8, the interior surfaces of plates 38, 40 may have a padded section for compressing against the spindles 20 and preventing damage to the spindles 20, similar in function and material to the padded section on the lower surface of the elongated bracket member 30 that interfaces with the handrail.

By bracing against the mid-height section of the railing and engaging the spindles 20, the bracket assembly 12 provides greater support than exclusively mounting the bracket assembly 12 to the handrail and does not rest on or occupy any floor space near railing. Also, as shown in FIGS. 1-4, the bracket assemblies 12 may be mounted on the railing 14 with the bracing members 36 on an exterior side of the railing 14, thereby avoiding any interference with the space below the tabletop 16 on the interior side of the railing 14, also referred to as knee space. It is conceivable, that one or more of the bracket assemblies may, however, be mounted to the railing with the bracing member on the interior side of the railing without departing from the invention.

Referring now to the tabletop system 110 shown in FIGS. 9-13A, the bracket assembly 112 includes a support bracket 126 that has an upper portion 126*a* that rests on the handrail of the railing and a lower portion 126*b* that extends downward from the upper portion 126*a* to allow the engagement device 128 to attach to at least one spindle of the railing. The lower portion 126*b* includes a bracing member 136 that extends generally linearly downward at an angle from the elongated bracket member 130 toward the spindles of the railing. Also, as shown in FIGS. 11-11B, the bracing member 136 may optionally include a vertical section 136*a* that initially extends directly downward from the elongated bracket member 130, before angling toward the spindles at the angled section 136*b*.

Figure 10:
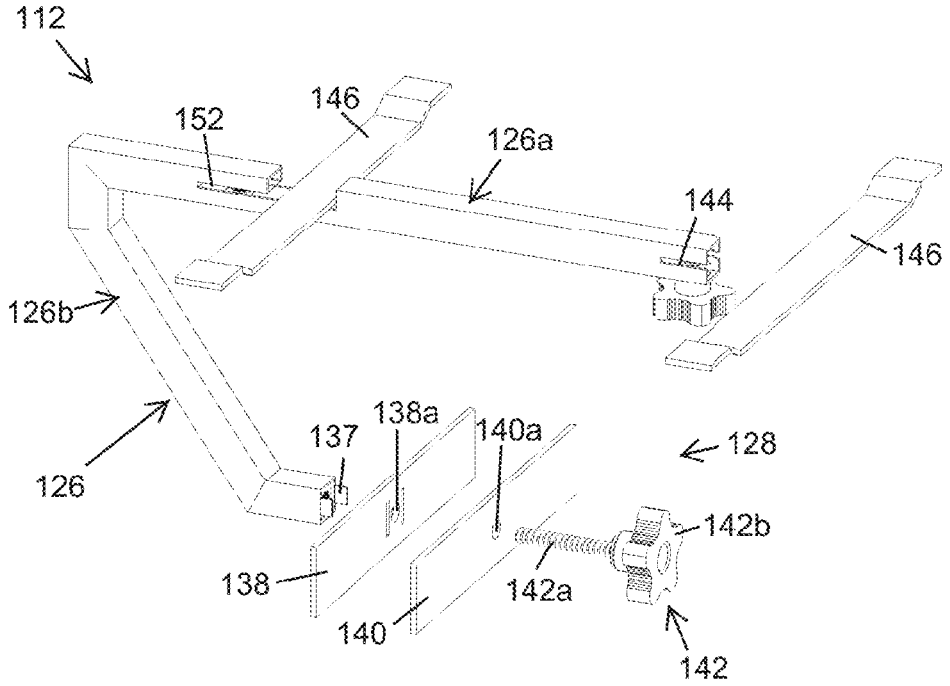
FIG. 10 is an upper perspective view of the bracket assembly shown in FIG. 9, with the tabletop base brackets moved away from bracket slots.
Figure 10A:
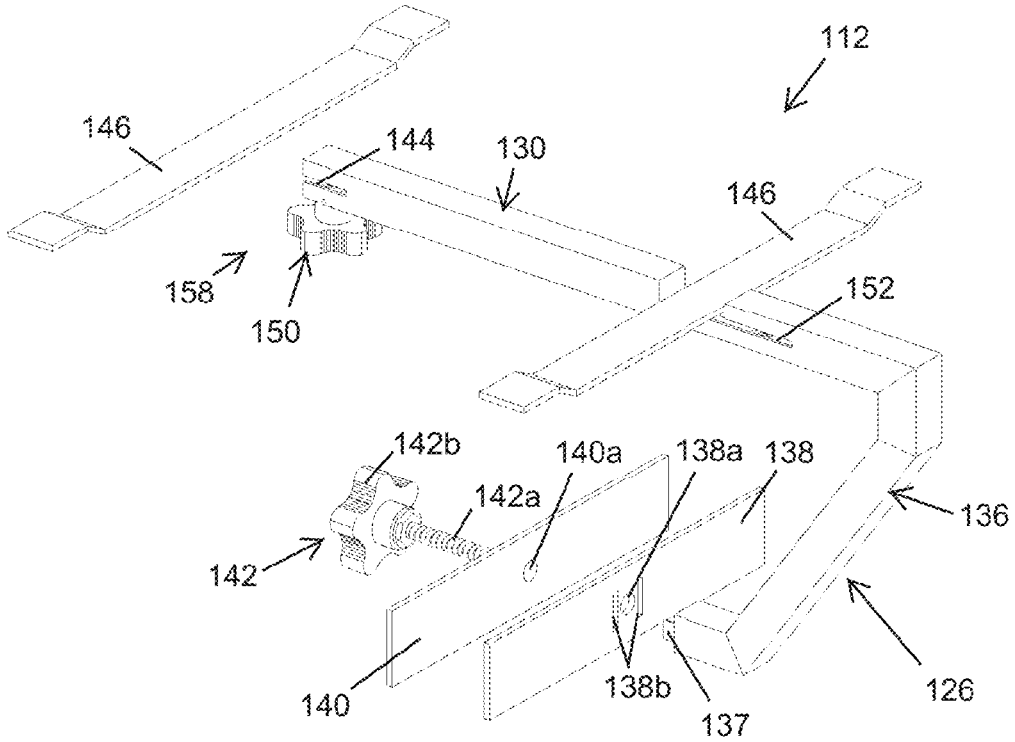
FIG. 10A is an upper perspective view of the bracket assembly shown in FIG. 10, taken from an opposing side of the bracket assembly.

As illustrated in FIGS. 9-12A, the engagement device 128 is disposed at the lower portion 126*b* of the bracket assembly 112 and is adapted to engage opposing sides of the spindle in a manner that temporarily secures to various types of spindles and accommodate spindles that are separated with different or inconsistent spacing. The engagement device 128 is configured to engage an adjacent pair of the substantially vertical spindles. The engagement device 128, as shown in FIGS. 10-10A, includes a first plate 138 that is configured to span laterally between outside surfaces of the adjacent pair of spindles and is provided with a pair of generally vertical slots 138*b* disposed on opposing sides of a central aperture 138*a*. The vertical slots 138*b* are arranged to receive tabs 137 disposed at the lower end of the brace member 136 for attaching the first plate 138 to the brace member 136, so that the first plate 138 is prevented from rotating relative to the brace member 136 and the railing, such as when tightening the fastener 142. The second plate 140 of the engagement device 128 is similarly configured to span between the adjacent pair of spindles and also includes a central aperture 140*a*. The central apertures 138*a*, 140*a* of the first and second plates 138, 140 may receive a threaded shank 142*a* of the fastener 142, such that a rotary handle 142*b* of the fastener 142 contacts an outside surface of the second plate 140. For adjustably moving the second plate 140 to a secured position in abutting engagement with the spindles, the threaded shank 142*a* may be inserted and rotationally engaged with a nut 139 fixed at an interior of the end of the brace member 136, as shown in FIG. 11B. The fastener 142 is then rotated to draw the second plate 140 into contact with the spindle, thereby clamping the spindle between the first and second plates 138, 140.

As also shown in FIGS. 9-11B, the upper portion 126*a* of the bracket assembly 112 includes an elongated bracket member 130 that is configured to span over the handrail of a railing and support a tabletop in a substantially horizontal orientation over the handrail. The elongated bracket member 130 may configured to removably engage the tabletop, such as with an attachment feature that may be provided at the bracket assembly 112 and/or the tabletop.

With respect to an attachment feature disposed at the bracket assembly, as shown for example in FIGS. 9-11B, the upper portion 126*a* of the bracket assembly 112 includes a horizontal retention slot 144 disposed at a front end of the top bracket member 130 opposite the end having the brace member 136. The retention slot 144 is arranged to receive a tabletop base bracket 146 that is disposed at or otherwise secured to a lower portion of the tabletop supported by the bracket assembly 112. The front end of the top bracket member 130 may also include a threaded nut 148 disposed at an interior of the tube forming the top bracket member, such as shown in FIGS. 11-11B. The nut 148 receives a hand-threaded fastener 150, substantially similar to the fastener 142 used in the engagement device 128, such that the fastener 150 is threaded into the nut 148 to engage and hold the tabletop base bracket 146 in the slot 144. Similarly, another horizontal retention slot 152 is disposed at a back end portion of the top bracket member 130 to receive another tabletop base bracket 146 that is disposed at or otherwise secured to a lower portion of the tabletop supported by the bracket assembly 112. The rear retention slot 152 may also include a threaded nut 148 disposed at an interior of the tube, such as shown in FIGS. 11-11B, for receiving a hand threaded fastener 150. This fastener 150 is also threaded into the nut 148 to engage and hold the tabletop base bracket 146 in the slot 152. The retention slots 144, 152 and the fasteners 150 provide releasable attachment features 158 for engaging the tabletop in a quick and simple manner.

Accordingly, the tabletop base brackets 146 or underbars may also be considered attachment features disposed at the tabletop. The illustrated base brackets 146 are configured with ends that secure to the bottom surface of the tabletop, providing a gap between the bottom surface of the tabletop and the mid-section of the base brackets. The base brackets 146 are configured to extend substantially parallel to the length of the tabletop, such that the bracket assemblies 112 can selectively engage the tabletop at a plurality of locations along the mid-sections of base brackets, which correspond to being along the length of the tabletop, further allowing the tabletop to be positioned at multiple positions along a length of the handrail. It is contemplated that the tabletop base brackets or underbars may be an integral part of the tabletop, such as by being formed into a tabletop or molded as an integral piece of a tabletop.

Referring now to FIGS. 14-17, the tabletop 16 is generally positioned over and engaged with the handrail 18 of the railing 14 (via the bracket assembly), with a rear portion extending over an exterior side of the railing 14 and a front portion extending over interior side of the railing 14. The bracket assembly 12 shown in FIGS. 14-17 includes a releasable attachment feature 58 and a rigid attachment feature 60 on opposing ends of the top elongated bracket member 30 to engage the tabletop 16. These two attachment features together secure the tabletop 16 on the respective bracket assembly 12 to prevent both vertical and horizontal movement. The rigid attachment feature 60 has an upward protrusion 62 on the outside end of the top bracket member 30 that is configured to contact a rear edge 16*a* (FIG. 17) of the tabletop 16 and thereby prevent rearward movement thereof. The upward protrusion 62 is also illustrated with an inward flange 64 that engages an upper surface of tabletop 16 along the rear edge 16*a*, thereby preventing upward movement of the tabletop 16 at least proximate the rear edge 16*a*. In the illustrated embodiment, the inward flange 64 engages a horizontal slot 66 formed on the rear edge of the tabletop 16, between the upper surface of the tabletop and an upstanding wall 68 that extends along the rear edge of the tabletop. Such a horizontal slot 66 allows the inward flange 64 to selectively engage the tabletop at different longitudinal positions along the rear edge 16*a*. The upstanding wall 68 shown in the illustrated embodiments may also be provided to generally prevent objects from falling off the edges of the tabletop. It is contemplated that the upward protrusion, may optionally engage a vertical slot through the tabletop and/or the inward flange may optionally engage a differently arranged slot on the rear edge of the tabletop.

With reference to the releasable attachment feature 58 on the bracket assemblies 12 shown in FIGS. 14-17, the tabletop 16 is provided with a base bracket 70 or underbar that is secured to the bottom surface of the tabletop and arranged to extend in parallel alignment with the rear edge 16*a* of the tabletop at a spaced distance from the rear edge 16*a*. The base bracket 70 may be configured to allow the attachment features 58 on multiple bracket assemblies 12 to simultaneous engage the tabletop 16. The illustrated embodiment of the releasable attachment feature 58 also includes a horizontal slot 72 formed on the front end of the elongated bracket member 30 in general alignment with a flange 74 that extends along the length of the base bracket 70. A threaded fastener 76 may extend upward through an end portion of the bracket member 30 below the horizontal slot 72, such that the threaded fastener 76 may be adjusted upward into the horizontal slot 72 when the flange 74 is inserted in the slot 72. In such an arrangement, the threaded fastener 76 may be manually threaded upward to contact the flange 74 and thereby form a secured and releasable connection. Similar to the rigid attachment feature 60, the releasable attachment feature 58 is configured to selectively engage the tabletop at a plurality of locations along a lower surface of the tabletop 16. Further, it is contemplated that the releasable attachment features on the tabletop and bracket assemblies may be reversed, where the tabletop may optionally include the releasable attachment feature or clip and the bracket assembly may include a feature similar to the underbar for engaging the clips on the table.

Referring now to FIGS. 18-21, an additional embodiment of the releasable attachment feature 258 or underbar clip is illustrated having a spring-biased clasp 278 facing inward to engage a differently configured base bracket 270 or underbar on the lower side of the tabletop. The spring-biased clasp 278 includes a hook member that is spring-biased upward about a hinge. The hook member has a front end that is angled to engage a displacement surface of the base bracket 270, such that upon sliding the tabletop 216 rearward along the bracket assemblies 212, the hook member is caused to contact the base bracket 270 and rotate the hook member downward until the front end passes a downward extending flange on the base bracket 270. Further movement of the tabletop 216 rearward allows the hook member to overcome the displacement surface and rotate, via the spring bias, upward and engage the downward extending flange on the base bracket 270. The base bracket 270 is designed for the spring-biased clasp 278 to selectively engage the tabletop 216 at a plurality of locations longitudinally along a lower surface of the tabletop 216, allowing for multiple configurations of the bracket assemblies. The spring-biased clasp 278 may also include a release trigger that may be depressed to move the hook member downward out of engagement with the base bracket 270 for disengaging and removing the tabletop 216 from the bracket assembly 212.

Yet another embodiment of the releasable attachment feature 358 is illustrated in FIGS. 22-25 having a wedge-shaped member 384 for engaging a base bracket 370 or underbar on the lower surface of the tabletop 316 in a releasable manner. The wedge-shaped member 384 is movable toward and at least partially into the elongated bracket member 330 for placing an angled surface of the wedge-shaped member 384 in substantially planar alignment with the bottom surface of the elongated bracket member 330. To move the wedge-shaped member 384 upward, the angled surface interfaces with a back edge of the base bracket 370, which has an elongated opening between the base bracket 370 and the bottom surface of the tabletop 316. With rearward movement of the tabletop 316, the wedge-shaped member 384 moves upward until it passes the base bracket 370, whereby it moves downward, such as with the spring bias or as a result of gravity, placing an end surface of the wedge-shaped member 384 in restricting contact with the base bracket 370, preventing forward movement of the tabletop 316. The base bracket 370 also prevents upward movement of the front edge of the tabletop 316 after engaging the bracket assemblies 312. Similar to the base bracket described above, the base bracket 370 is also designed with the elongated openings for the releasable attachment feature to selectively engage the tabletop at a plurality of longitudinal locations along a lower surface of the tabletop.

Figure 26:
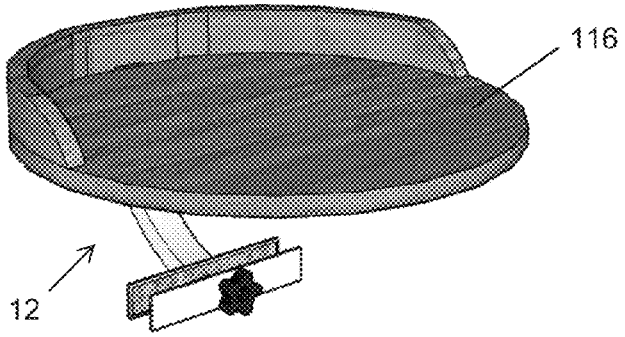
FIG. 26 is an upper perspective view of a circular tabletop supported by a single bracket assembly.
Figure 27:
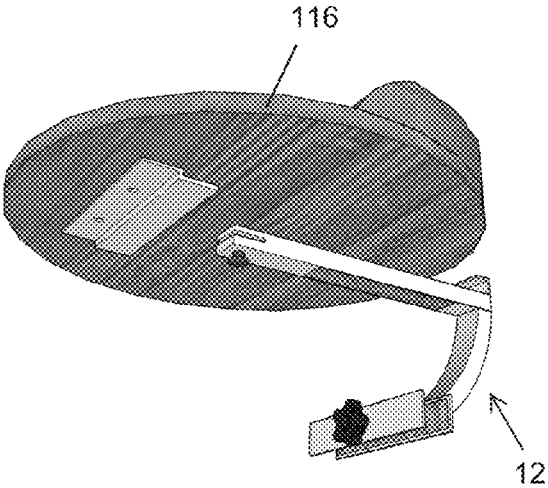
FIG. 27 is a lower perspective view of the circular tabletop disengaged from the bracket assembly shown in FIG. 26.
Figure 28:
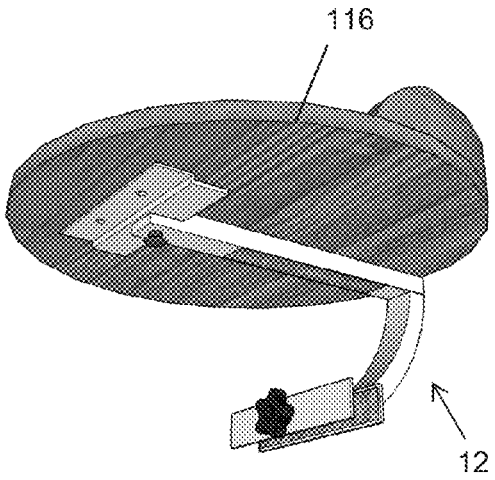
FIG. 28 is a lower perspective view of the circular tabletop engaged with the bracket assembly shown in FIG. 26.

The tabletop that attaches to the bracket assemblies of the present tabletop system has a substantially planar upper surface for supporting objects. However, the upper surface may be differently shaped and configured for other uses, such as with a drain area or an opening for inset containers or items. The tabletop may also vary in width, length, and thickness to accommodate the desired tabletop surface area configuration. For example, the tabletop 16 may be a long rectangular tabletop that is supported with more than one bracket assembly 12 and capable of supporting multiple place settings to accommodate multiple barstools, such as shown in FIGS. 1-4, and may be a circular tabletop 116 supported with a single bracket assembly 12, such as shown in FIGS. 26-28. Accordingly, various tabletops are capable of being attached to the bracket assemblies of the present table system, in multiple locations along the length of the railing. As such, the bracket assemblies may be first attached to suitable locations on the railing and then the tabletop may be fit to the bracket assembly arrangement on the railing. Such attachment between the tabletop and the bracket assemblies may be effectuated with multiple different attachment features in various configurations, some of which are specifically shown and described herein.

With respect to the general installation method, the connection steps may be performed in various different sequences to result in connecting or disconnecting the tabletop system with a supportive railing. In one example, the method for detachably engaging the tabletop to a railing includes placing a lower surface of the elongated member of the bracket assembly in contact with the top surface of a handrail of the railing. A lower end of the bracing member is then positioned between an adjacent pair of spindles of the railing. With the elongated bracket member in a generally level horizontal alignment, an adjacent pair of the spindles may then be are clamped or attached with an engagement device at the lower end of the bracing member. The bracing member thereby supports the elongated member in the substantially horizontal orientation. The tabletop is then attached to the elongated member in the substantially horizontal orientation, providing a substantially planar upper surface of the tabletop, such as a bar top, a counter top, or other table-like structure. The bracket assembly thereby is firmly, yet temporarily, supported on the railing for attaching the tabletop in a substantially horizontal orientation. With these described embodiments, the lower portion of the bracket assembly may be adapted to secure to various types of spindles and accommodate spindles that are separated with different or inconsistent spacing. Also, to accommodate different placements of the bracket assemblies, the bracket assembly may also be configured to selectively attach to the tabletop at multiple locations. The detachable tabletop system of the present invention thereby provides the ability to customize and interchange the tabletop as desired, as well as the ability to easily detach and store the tabletop system when not in use.

For purposes of this disclosure, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

Changes and modifications in the specifically described embodiments may be carried out without departing from the principles of the present invention, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A tabletop system configured to detachably engage a railing, said tabletop system comprising:

a railing bracket having (i) an upper portion that includes an elongated bracket member with a bottom surface that is configured to rest on a handrail of a railing and (ii) a lower portion that includes a bracing member that integrally extends downward from a first end section of the elongated bracket member;

wherein the elongated bracket member includes a first attachment feature disposed at the first end section of the elongated bracket member and a second attachment feature disposed at an opposing second end section of the elongated bracket member;

a tabletop having a substantially planar upper surface and being configured to removably engage the upper portion of the railing bracket via the first and second attachment features and span over opposing sides of the handrail;

wherein the lower portion of the railing bracket includes an engagement device that is configured to secure to at least one spindle of the railing for supporting the substantially planar upper surface of the tabletop in a generally horizontal orientation; and wherein, when the railing bracket is secured to the railing, a central section of the elongated bracket member rests on the railing to position the first and second attachment features at the opposing sides of the handrail.

2. The tabletop system of claim 1, wherein the first and second attachment features detachably engage the tabletop to the railing bracket.

3. The tabletop system of claim 2, wherein the first and second attachment features are configured to selectively engage the tabletop at a plurality of locations along a length of the tabletop, allowing the tabletop to be positioned a multiple positions along a length of the handrail.

4. The tabletop system of claim 1, wherein the bracing member that extends downward from the upper portion of the railing bracket is configured to be arranged on an exterior side of the railing to prevent disruption of a knee area under the tabletop at an interior side of the railing.

5. The tabletop system of claim 1, wherein the upper portion of the bracket assembly includes an elongated bracket member that has a top surface for supporting the tabletop.

6. The tabletop system of claim 1, wherein the engagement device is disposed at a bottom end of the bracing member and is configured to engage opposing sides of the at least one spindle for rigidly securing the railing bracket to the railing.

7. The tabletop system of claim 6, wherein the engagement device includes a pair of clamping members that engage the opposing sides of the at least one spindle and a fastener that extends between and draws the pair of clamping members toward each other for clamping the at least one spindle between the clamping members.

8. A tabletop system configured to detachably engage a railing, said tabletop system comprising:

a railing bracket having (i) an upper portion that includes an elongated bracket member with a bottom surface that is configured to rest on a handrail of a railing and support a tabletop that spans over the handrail and (ii) a lower portion that includes a bracing member that extends downward from a first end section of the elongated bracket member;

an engagement device disposed at the lower portion of the bracing member and configured to attach to at least one spindle of the railing, wherein the engagement device is configured to engage opposing sides of the at least one spindle for rigidly securing the railing bracket to the railing;

wherein the elongated bracket member includes a first attachment feature disposed at the first end section of the elongated bracket member and a second attachment feature disposed at an opposing second end section of the elongated bracket member;

wherein, when the railing bracket is secured to the railing, the first and second attachment features are positioned at opposing sides of the handrail; and a base bracket that detachably engages the first and second attachment features of the railing bracket and that is configured to attach to a bottom portion of the tabletop for supporting the tabletop in at the railing bracket.

9. The tabletop system of claim 8, wherein the upper portion of the railing bracket includes an elongated bracket member that is configured to span over the handrail, and wherein the elongated bracket member has a top surface for supporting the tabletop and a bottom surface with a padded section configured to contact against the handrail of the railing.

10. The tabletop system of claim 9, wherein the bracing member integrally extends downward from the first end section of the elongated bracket member and is configured to angle toward spindles of the railing to be arranged on an exterior side of the railing.

11. The tabletop system of claim 8, wherein the engagement device includes a pair of clamping members that engage the opposing sides and are moved toward each other for clamping the at least one spindle between the clamping members.

12. The tabletop system of claim 11, wherein the engagement device includes a threaded fastener that extends between the pair of clamping members and, upon rotation of the threaded fastener, draws the pair of clamping members toward each other for engaging opposing sides of the at least one spindle.

13. The tabletop system of claim 8, further comprising a tabletop attached at the base bracket, wherein the tabletop has a substantially planar upper surface that is arranged generally horizontally when the base bracket is attached at the railing bracket.

14. The tabletop system of claim 13, wherein at least one of the first and second attachment features of the upper portion of the railing bracket includes a slot for engaging the base bracket below the tabletop.

15. The tabletop system of claim 13, wherein the first and second attachment features are configured to selectively engage the attachment feature of the base bracket at a plurality of locations along a length of the tabletop, allowing the tabletop to be positioned at multiple horizontal positions along a length of the handrail.

16. A tabletop system configured to detachably engage a railing, said tabletop system comprising:

a railing having a plurality of spindles that support a handrail, wherein the railing borders a platform surface to define an interior side of railing adjacent to the platform surface;

a railing bracket having (i) an elongated upper bracket member that includes a bottom surface that is configured to rest on the handrail of the railing and (ii) a lower bracket member that extends downward from a first end section of the elongated upper bracket member for extending toward and bracing against the spindles of the railing;

an engagement device disposed at a lower end of the lower bracket member and configured to engage opposing sides of the spindles of the railing for securing the railing bracket to the railing;

wherein the elongated upper bracket member includes a first attachment feature disposed at the first end section of the elongated bracket member and a second attachment feature disposed at an opposing second end section of the elongated upper bracket member;

wherein, when the railing bracket is secured to the railing, the first attachment feature is positioned at an exterior side of the handrail and the second attachment feature is positioned at the interior side of the handrail; and a tabletop detachably engaged with the first and second attachment features of the railing bracket and, when the railing bracket is secured to the railing, the tabletop spans over the handrail of the railing.

17. The tabletop system of claim 16, wherein the engagement device includes a pair of clamping members that engage the opposing sides of the spindles and are moved toward each other for clamping the spindles between the clamping members.

18. The tabletop system of claim 16, wherein the engagement device includes a threaded fastener that extends between the pair of clamping members and, upon rotation of the threaded fastener, draws the pair of clamping members toward each other for engaging opposing sides of the spindles.

19. The tabletop system of claim 16, further comprising a base bracket that detachably engaged with the first and second attachment features of the railing bracket, wherein the tabletop is attached at the base bracket, and wherein the base bracket is configured to engage a slot disposed at the upper bracket member of the support bracket.

20. The tabletop system of claim 16, wherein at least one of the first and second attachment features includes a hand-adjustable fastener that extends through a portion of the support bracket to engage the tabletop and prevent the tabletop from moving relative to the support bracket.

* * * * *